United States Patent [19]

Vertegaal

[11] 4,008,684

[45] Feb. 22, 1977

[54] DEVICE FOR APPLYING A LAYER OF A VISCOUS SUBSTANCE

[75] Inventor: Jacobus Gerardus Vertegaal, Boxmeer, Netherlands

[73] Assignee: Stork Brabant B.V., Boxmeer, Netherlands

[22] Filed: Jan. 12, 1976

[21] Appl. No.: 648,286

[30] Foreign Application Priority Data

Jan. 10, 1975 Netherlands ..... 7500344

[52] U.S. Cl. ..... 118/123; 118/204; 118/411; 15/256.5

[51] Int. Cl.[2] ..... B05C 11/04; B05C 3/18

[58] Field of Search ..... 118/123, 126, 204, 411, 118/412, 413, 415; 15/256.5; 101/115, 116

[56] References Cited

UNITED STATES PATENTS

| | | | |
|---|---|---|---|
| 1,641,959 | 9/1927 | Breiding | 15/256.5 |
| 1,857,241 | 5/1932 | Edmondson | 118/123 |
| 3,352,706 | 11/1967 | Alkofer | 118/123 X |
| 3,621,814 | 11/1971 | Sugarman et al. | 118/411 |
| 3,667,426 | 6/1972 | Vertegaal | 118/123 |

FOREIGN PATENTS OR APPLICATIONS

| | | | |
|---|---|---|---|
| 204,314 | 8/1939 | Switzerland | 118/413 |
| 596,525 | 1/1948 | United Kingdom | 118/123 |
| 1,218,718 | 1/1971 | United Kingdom | 118/204 |

*Primary Examiner*—James Kee Chi
*Attorney, Agent, or Firm*—Edmund M. Jaskiewicz

[57] ABSTRACT

A device for applying a layer of a viscous substance upon a travelling belt, comprising a perforated spraying tube and a squeegee blade, said blade having a curved shape with its convex side turned in the direction of travel of the belt.

4 Claims, 3 Drawing Figures

DEVICE FOR APPLYING A LAYER OF A VISCOUS SUBSTANCE

BACKGROUND OF THE INVENTION

My invention relates to a device for applying a layer of a viscous substance to a travelling belt, comprising at least one member for applying the substance to the surface of the belt and a squeegee for equalizing the layer to be applied. Such devices are known in various versions; they often present the drawback, however, that unwanted substance is deposited towards the edges of the belt originating from the substance flowing off on opposite ends of the squeegee.

SUMMARY OF THE INVENTION:

My invention seeks in the first place to overcome this trouble by giving the squeegee a curved shape, with its convex side turned to the direction of travel of the belt. Due to this feature an inwardly directed component is exerted on the substance flowing in the proximity of the ends of the squeegee, preventing the substance from flowing off along the opposite ends of the squeegee.

I have further found that on applying a substance with a different viscosity, a readjustment of the squeegee is no longer required as was necessary so far with a straight squeegee. It appears that due to its curved shape the squeegee has a greater stability at particular velocities of the belt, since eventual vibrations in the blade are prevented due to the curved shape according to the invention. A better contact with the travelling belt is acquired due to the fact that the curved squeegee can be tilted, creating the possibility of an adjustment of the squeegee blade in the central area of the belt.

My invention relates in particular to a gluing device for the supporting belt (printing cover) of a printing machine, provided with a perforated tubular element, situated transverse to the direction of travel of the belt, for applying the glue. According to my invention the gluing member comprises two tubes which are staggered with respect to each other, at least one of them being movable in a longitudinal direction, that is to say transverse to the direction of travel of the belt. With this embodiment no adjustment for width is necessary since by adjustment of the tubes any desired breadth dimension of the layer of viscous substance can be obtained.

In an embodiment both the member for applying the viscous substance and the squeegee are arranged on a mounting frame which is pivotally supported along a line transverse to the direction of travel upon a mobile underframe. Between the underframe and the mounting frame a supporting member is arranged on a side opposite to the pivotal axis, said supporting member being adjustable in height. This embodiment allows an adjustment of the compressive force of the squeegee against the travelling belt by a simple pivotal movement, constituting a simplification of the so far known possibility of adjustment.

Figure 1:
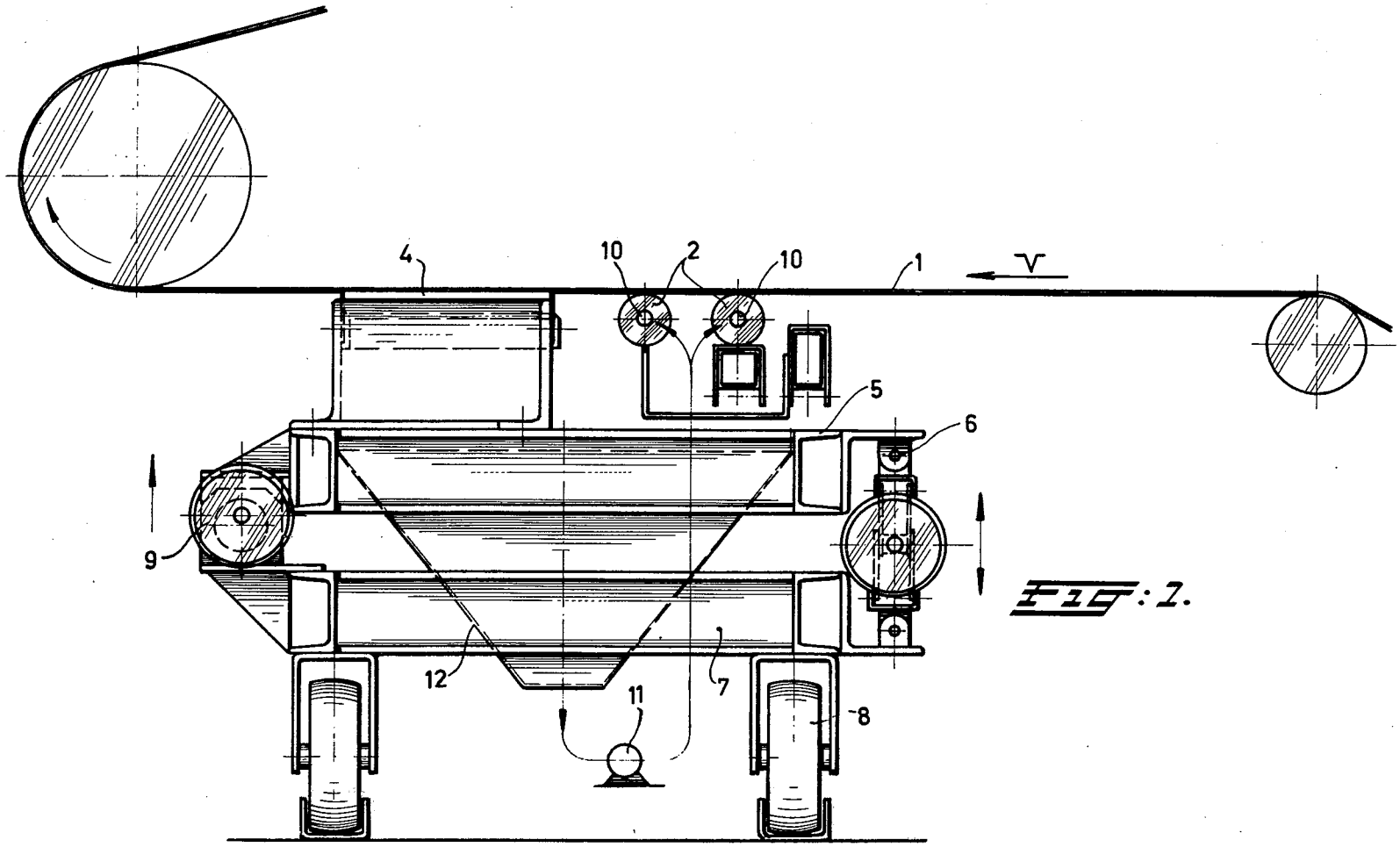
FIG. 1 is a side elevation of a mobile gluing device;.

DESCRIPTION OF PREFERRED EMBODIMENTS:

The device shown in the drawing forms part of a rotary screen printing machine of the type as described in my earlier U.S. Pat. Nos. 3,304,860, 3,420,167, 3,675,571, 3,718,086 and my copending Application Ser. No. 394,645 filed Sept. 5, 1973. In all these known printing machines a travelling belt (printing cover) is used said belt in the present device being denoted by the reference numeral 1 in FIG. 1. In order to apply the desired layer of a viscous substance such as glue on this belt, two elements are essential. The first element consists of two tubes 2 with perforations 3 and staggered with respect to each other. The other element consists of a squeegee 4 for smoothing the layer to be applied. The two elements 2 and 4 are mounted on a mounting frame 5 which is pivotally supported at 6 by an underframe 7, the latter being mobile by means of some wheels 8. Between the underframe 7 and the mounting frame 5, a supporting member 9 is arranged on a side opposite to the pivotal axis 6 said member being adjustable in height.

The two tubes 2 receive the viscous substance via two ducts 10 which are connected with a pump 11 (see FIG. 1). This pump 11 will suck the viscous substance from a through-shaped container 12 mounted in frame 5 and situated underneath both the two tubes 2 and the squeegee 4. The tubes 2 are slidable along the ducts 10, so that the width of the path, on which, via the perforations 3 the viscous substance is applied to belt 1, can be adjusted.

Figure 2:
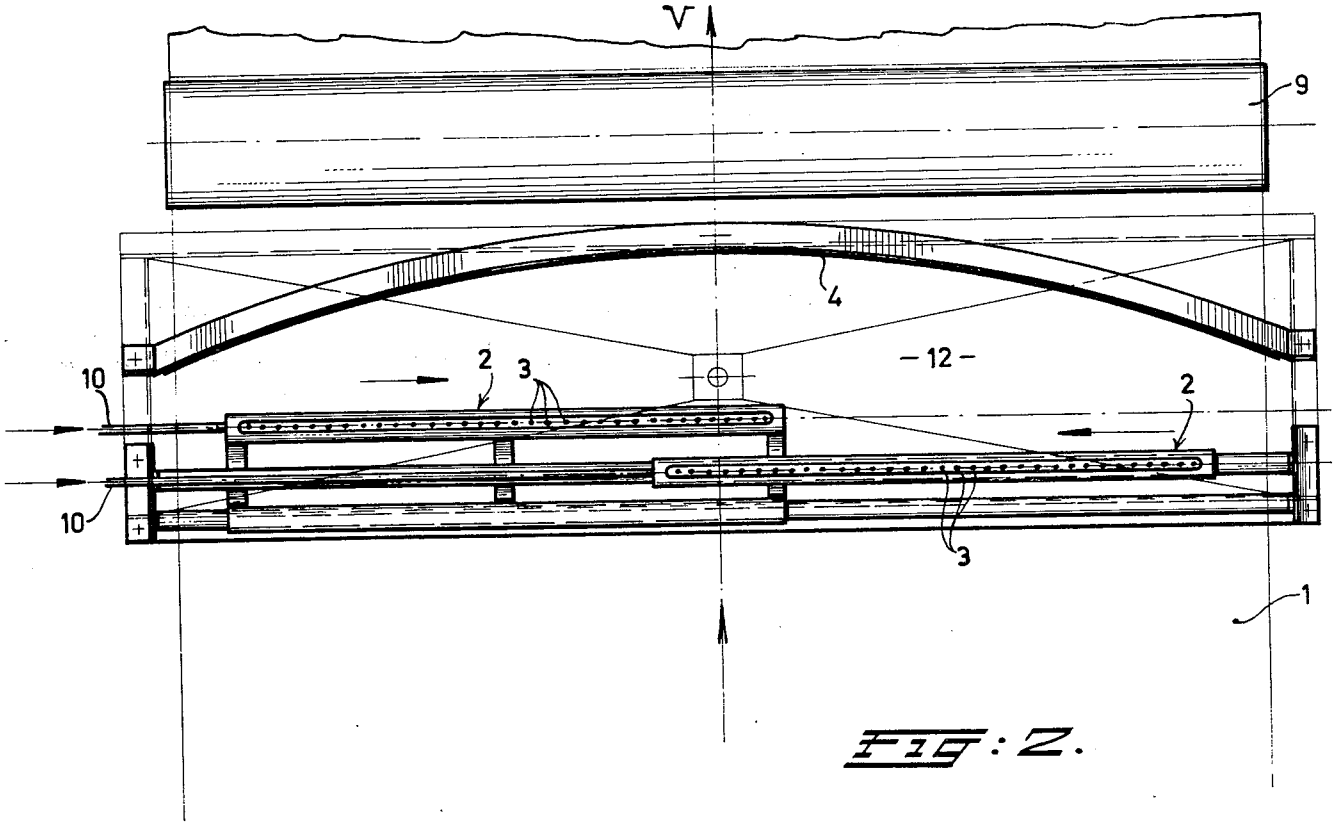
FIG. 2 is a plan view of the device according to FIG. 1.

As is best seen in FIG. 2 squeegee 4 has a curved shape, with its convex side turned to the direction of travel V of the belt 1. Due to this shape the viscous substance will not tend to flow off on opposite ends of the squeegee 4 towards both edges of the belt 1 as is often the case with a straight squeegee. My invention allows therefore to obtain a uniform layer of the substance on the belt under different circumstances as to velocity of the belt and viscosity of the substance, without the substance leaking away towards the sides.

Figure 3:
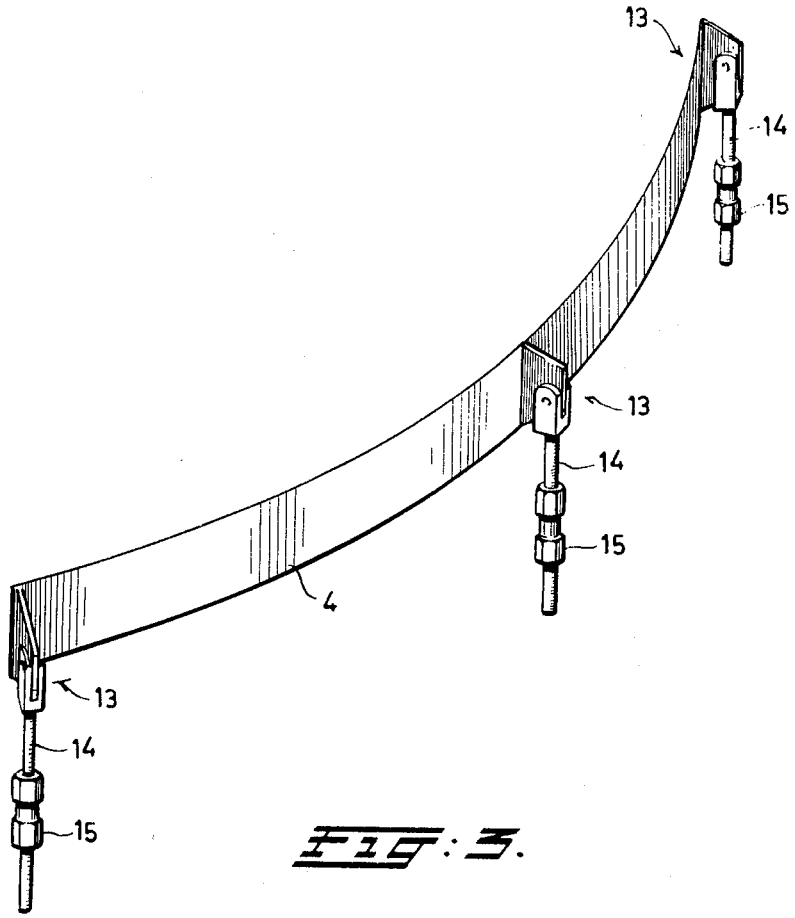
FIG. 3 is a perspective view of a modification of squeegee.

Contact with squeegee 4 with the belt 1 is also improved owing to the curved shape, the squeegee being moreover adjustable as shown in FIG. 3. The squeegee blade 4 is pivotally supported at three locations 13. The height of the locations 13 can be adjusted by means of a threaded rod 14 with nut 15 in order to obtain an exact adjustment of the contact.

What I claim is:

1. A device for applying a layer of viscous substance to a traveling belt comprising means for applying viscous substance to a surface of a traveling belt, a squeegee blade adjacent said surface of the belt and spaced from said applying means in the direction of travel of said belt to smooth the applied substance to obtain a uniform layer thereof, said blade having a curved shape across said belt, the curved blade having a convex side directed in the direction of travel of the belt.

2. A device according to claim 1 wherein said squeegee blade is pivotally supported at three locations uniformly spaced along the length of said blade.

3. A device according to claim 1 wherein said applying means comprises perforated tubular means situated transverse to the direction of travel of the belt, said tubular means comprising two tubes, staggered with respect to each other, one of which at least being movable in a longitudinal direction, i.e., transverse to the direction of travel of the belt.

4. A device according to claim 3 wherein said viscous substance applying means and said squeegee blade are arranged on a mounting frame which is pivotally supported along a line transverse to the direction of travel of said belt, a supporting member being arranged between an underframe and said mounting frame on a side opposite to the pivotal axis, and means for adjusting the height of said supporting member.

* * * * *